United States Patent [19]

Ring

[11] 3,960,105

[45] June 1, 1976

[54] SOUND MAKING SYSTEM

[75] Inventor: Thomas F. Ring, Indianapolis, Ind.

[73] Assignee: P. R. Mallory & Co., Inc., Indianapolis, Ind.

[22] Filed: Feb. 14, 1975

[21] Appl. No.: 549,873

[52] U.S. Cl. ..... 116/22 R; 58/9; 116/73; 116/167

[51] Int. Cl.[2] ..... G04B 23/00; G10K 1/32

[58] Field of Search ..... 116/160, 152, 25, 148, 116/149, 155, 164, 167, 169, 22 R, 73 R; 340/402; 46/33, 175; 84/103, 406, 407, 404; 58/21.12, 8, 9, 10, 12

[56] References Cited

UNITED STATES PATENTS 2,104,963 1/1938 Anderson ..... 84/103

3,144,851 8/1964 Chiarello ..... 84/404

FOREIGN PATENTS OR APPLICATIONS 811,334 8/1951 Germany ..... 84/404

*Primary Examiner*—Richard C. Queisser
*Assistant Examiner*—Daniel M. Yasich
*Attorney, Agent, or Firm*—Hoffmann, Meyer & Hanson

[57] ABSTRACT

Energy is slowly stored in at least two spring members mounted juxtaposition one another, the stored energy being released substantially instantaneously and individually, a single member engaging a striker first, the striker then engaging an alarm device such as a bell, subsequent members striking prior members to move the striker and again engage the alarm device.

12 Claims, 5 Drawing Figures

SOUND MAKING SYSTEM

Generally speaking, the present invention relates to a sound making system which comprises a noise making device; a spring loaded striker intermittently engaging the noise making device; at least two spring members mounted juxtaposition one another, a distal end of the members engaging the striker; and means for slowly storing energy in said members substantially simultaneously and individually, a first member striking said spring loaded striker upon release of the energy in the member and the next succeeding member striking said first member so as to provide individual sounds in a predetermined sequence.

There are many applications for noise making systems wherein a noise making device such as a bell provides an audible sound. For example, there are many applications in clock radio timers, alarm clocks, inexpensive clock striking mechanisms, and multi-sound, end of cycle warning signals for timer applications in appliances. Many of these applications require multiple or repetitive types of sound generation. In these types of applications, especially where multiple sound generation is required, the apparatus sometimes become complicated, expensive and difficult to produce.

It is, therefore, a feature of the invention to provide a sound making system which is capable of producing multiple sounds. Another feature of the invention is to provide a sound making system capable of producing multiple, repetitive sounds that is simple, easy to produce, and therefore relatively inexpensive. Another feature of the invention is the provision of a sound making system wherein energy is slowly stored in at least two spring members mounted juxtaposition one another, the energy in the members then being individually released. Still another feature of the invention is to provide such a sound making system wherein the spring members strike a spring loaded striker to engage the striker with a sound making device. Yet still another feature of the invention is to provide such a sound making system wherein the energy is stored in the members by a rotating lug engaging the ends of the members to load same.

These and other features of the invention will become apparent from the following description taken in conjunction with the accompanying drawings wherein.

Figure 1:
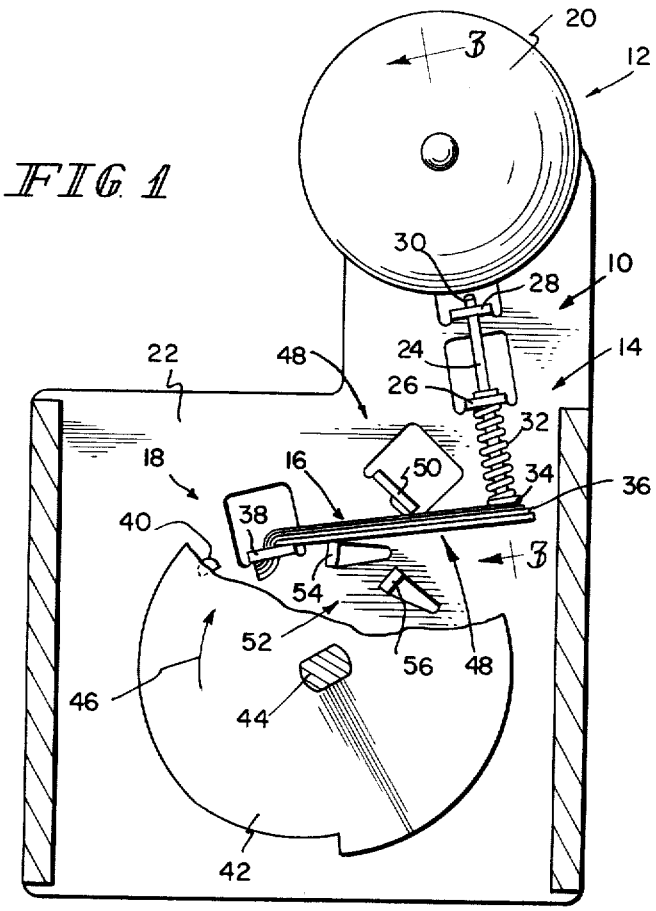
FIGS. 1 and 2 are plan views of the sound making system showing different operating positions.
Figure 3:
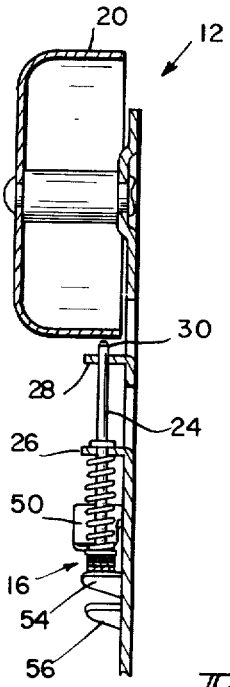
FIG. 3 is a section taken along the lines 3—3 of FIG. 1.
Figure 4:
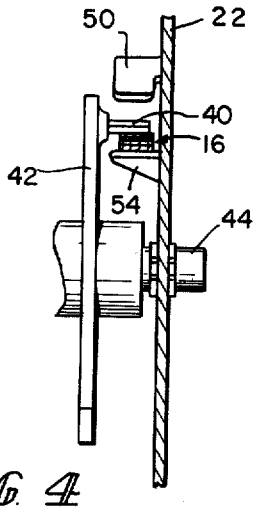
FIG. 4 is a partial elevation of the sound making system showing portions of the system.

Referring now to the drawing, sound making system 10 in general includes a noise making device 12, a spring loaded striker 14, spring members 16, and a means 18 for slowly storing energy in the members substantially simultaneously and for substantially instantaneously, but individually releasing the stored energy. The complete system is shown as being part of a timing mechanism, the system being carried for the most part on a plate 22 forming part of a housing for the timer. It should be understood, however, that the system need not be part of a timing mechanism.

Noise making device 12 comprises a bell 20. Striker 14 includes a rod 24 carried and axially movable in cooperating apertures provided in tangs 26 and 28 which are lanced from plate 22. Rod 24 has a slighty tapered end 30 which strikes bell 20 and is spring biased away from the bell through coil spring 32, the spring being held between tang 26 and a collar 34.

In the present embodiment of the invention spring members 16 are illustrated as being four spring blades 1–4, each being of a different thickness. Such difference in thickness, may be used to provide variations in the sound amplitude of the system. The blades may also be of the same thickness. The distal ends 36 of the blades are staggered such that each blade extends slightly beyond the end of the previous blade such that they may be individually released after energy is stored in the blades. Such staggering of the blades may be achieved by staggering them as mounted in a relaxed position or they may become staggered as energy is stored in them or they may be staggered by a combination of both. The blades, in their relaxed position, are held in juxtaposition and cantilevered at their ends opposite the distal end 36 by providing a tight fit in an aperture provided in tang 38 lanced from plate 22.

Means 18 for slowing storing energy in the blades substantially simultaneously and for releasing the energy substantially instantaneously and individually includes a lug 40 carried on disc 42 which is carried on shaft 44. Since the noise making system is shown being used in a timer, disc 42 is cut for operation as a cam. Shaft 44 may be rotated by hand, but in normal operation it would be power driven through a suitable power source such as a synchronous motor drive means.

Figure 2:
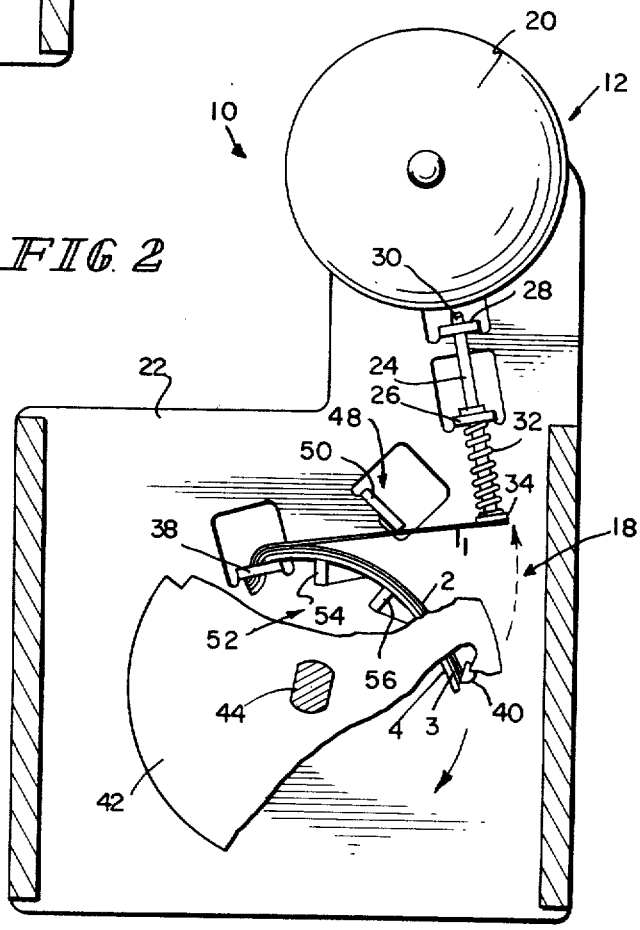

In operation, disc 42 is rotated in a direction illustrated by arrow 46. Upon rotation of the disc, lug 42 engages spring blades 1–4 at their distal ends and bends the blades to store energy therein. In FIG. 2, the blades have been bent to the point where lug 40 has passed the distal end of blade 1 to release the blade and permit it to strike striker 14 to ring the bell. As shown in FIG. 2, striker 14 is returning to its original position. As lug 42 passes the distal end of each successive blade, the blade is released to strike a prior released blade 6, move the striker and engage bell 20. The complete releasing of the blades will occur substantially simultaneously but yet individually so as to provide individual tones.

In order to prevent excessive vibration of the blades as they engage striker 14, a stop means 48 is provided to limit the travel of the blades. Stop means 48 includes a tang 50 lanced from plate 22. The stop means is disposed in cooperating relationship with striker 14 such that the travel of the blades can be limited and yet permit the striker to strike bell 20. Upon engagement of the first blade with the tang, its travel becomes limited thus curtailing the amplitude of vibration of the blade. Although the remaining blades do not directly engage tang 50, the effect is the same since the tang effectively limits the travel of the prior blade(s) upon being struck by the next successive blade. Each of the blades bends about tang 50 to accomplish a stroke of the bell and then each returns to a straight orientation after dissipation of their energy.

In order to insure a smooth, even bending of the blades at a proper curvature of bending there is provided a guide means 52. Guide means 52 includes tangs 54 and 56 lanced from plate 22 at suitable positions to insure proper bending of the blades. As the blades are bent by lug 42 they will, as shown in FIG. 2, bend around the tangs to form a proper arc.

It should be understood that the relative positions of lug 40 and spring members 16 could be reversed. That is, spring members 16 could be carried on disc 42 to be rotated thereby and lug 40 could be fixedly mounted on plate 22 in an interference path with the spring members. Thus, with reference to FIG. 5 there is shown spring members 16' (spring blades 1'–4') cantilevered in a hub 70 which carries disc 42, the members being cantilevered in slot 72 and extending into an aperture 74. Lug 40' is fixedly mounted on a plate 22 and is in an interference path with the spring blades. As in the case of the embodiment of FIGS. 1–4, there is a stop means 48' comprising a tang 50' lanced from the plate to prevent excessive vibrations of the blades as they engage striker 14. In order to insure a smooth bending of the blades at a proper curvature of bending there is provided, as was provided in the embodiment of FIGS. 1–4, a guide means 52' which in this embodiment includes a cam surface 76 formed as part of hub 70 around which the blades are bent as disc 42 and the hub are rotated. There is a pin 78 carried by disc 42 to maintain the blades juxtaposition one another and ready for their next engagement with lug 40' after they have passed stop means 48'.

Figure 5:
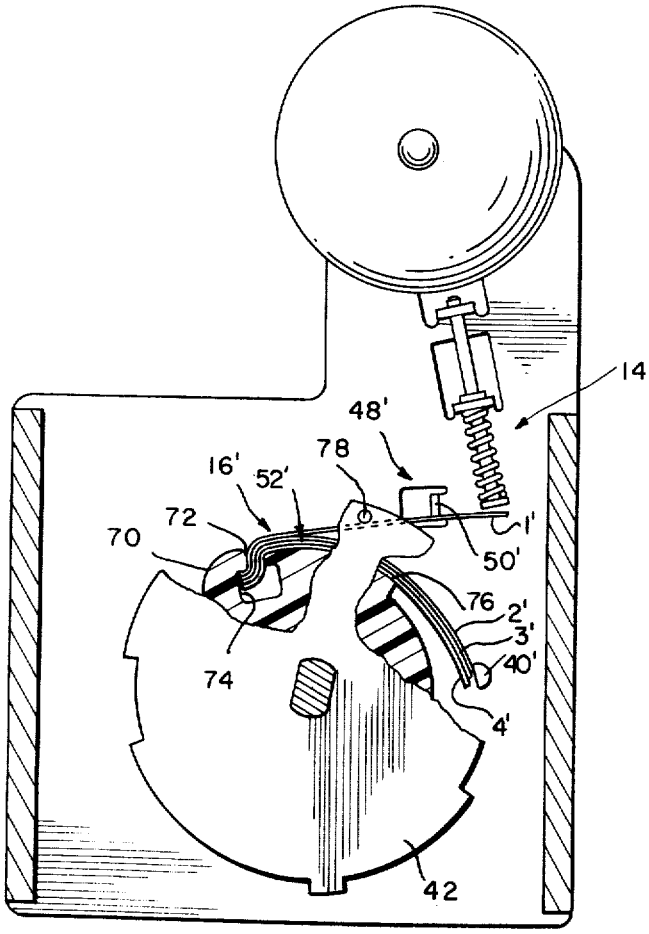
FIG. 5 is a view similar to FIG. 1 showing another embodiment of the invention.

The operation of the embodiment of FIG. 5 is basically the same as that of FIGS. 1–4. That is, as the blades are rotated by hub 70, they engage lug 40' to be bent and store energy therein, the blades then being individually released as they individually pass lug 40' to individually engage striker 14.

What is claimed is:

1. A sound making system comprising a. a noise making device, b. a spring loaded striker intermittently striking said noise making device, c. at least two spring members, mounted juxtaposition one another, a distal end of said members intermittently engaging said spring loaded striker, and d. means selectively engaging said members for slowly bending said spring members to store energy therein substantially simultaneously and for releasing said energy substantially instantaneously and individually, a first spring member striking said spring loaded striker and the next succeeding spring member striking said first spring member so as to provide individual sounds in a predetermined sequence.

2. A sound making system according to claim 1 wherein said spring members are blades.

3. A sound making system according to claim 2 wherein said blades are of different thicknesses.

4. A sound making system according to claim 2 wherein said distal ends are staggered.

5. A sound making system according to claim 4 wherein said spring blades are fixedly mounted and said means selectively engaging said blades comprises a rotating lug engaging said distal ends.

6. A sound making system according to claim 1 further comprising guide means cooperating with said means selectively engaging said blades to provide a smooth even bending of said blades.

7. A sound making system according to claim 6 wherein at least a portion of said sound making system is carried on a plate and said guide means include tangs extending from said plate.

8. A sound making system according to claim 1 wherein said spring loaded striker includes an axially movable rod engaging said sound making device, and a coil spring surrounding said rod and disposed between a tang extending from a plate carrying at least a portion of said noise making system and a collar carried by said rod.

9. A noise making system according to claim 1 further including stop means limiting the travel of said spring blades upon striking said spring loaded striker.

10. A noise making device according to claim 9 wherein said stop means includes a tang extending from a plate carrying at least a portion of said noise making system and disposed in cooperating relationship with said spring loaded striker such that the travel of said blades can be limited and yet permit said blades to strike said noise making device.

11. A noise making system according to claim 1 wherein said noise making device is a bell.

12. A noise making system according to claim 1 wherein said spring members are rotatably mounted and said means selectively engaging said spring members is a lug fixedly mounted in an interference path with said spring members.

* * * * *